US011045939B2

(12) United States Patent
Kotsuji et al.

(10) Patent No.: US 11,045,939 B2
(45) Date of Patent: Jun. 29, 2021

(54) POWER TOOL

(71) Applicant: MAKITA CORPORATION, Anjo (JP)

(72) Inventors: Takafumi Kotsuji, Anjo (JP); Akira Mizutani, Anjo (JP)

(73) Assignee: MAKITA CORPORATION, Anjo (JP)

( * ) Notice: Subject to any disclaimer, the term of this patent is extended or adjusted under 35 U.S.C. 154(b) by 209 days.

(21) Appl. No.: 16/256,516

(22) Filed: Jan. 24, 2019

(65) Prior Publication Data

US 2019/0299387 A1 Oct. 3, 2019

(30) Foreign Application Priority Data

Mar. 28, 2018 (JP) ..... JP2018-062172

(51) Int. Cl.

| | |
|---|---|
| ***B25F 5/02*** | (2006.01) |
| ***B25B 21/02*** | (2006.01) |
| ***B25D 16/00*** | (2006.01) |
| ***B26D 1/30*** | (2006.01) |
| ***B27B 19/00*** | (2006.01) |
| *B25B 23/14* | (2006.01) |
| *B25F 3/00* | (2006.01) |

(52) U.S. Cl.

CPC ..... *B25F 5/02* (2013.01); *B25B 21/02* (2013.01); *B25D 16/006* (2013.01); *B26D 1/30* (2013.01); *B27B 19/006* (2013.01); *B25B 23/141* (2013.01); *B25F 3/00* (2013.01)

(58) Field of Classification Search

CPC ..... B25D 16/006; B26D 1/30; B23D 17/04; B27B 19/006; B25F 3/00; B25F 5/02; B25B 23/141; B25B 21/02; B24B 47/16

See application file for complete search history.

(56) References Cited

U.S. PATENT DOCUMENTS

| | | | |
|---|---|---|---|
| 78,652 | A | 6/1868 | Criag |
| 3,233,908 | A | 2/1966 | Walter et al. |
| 3,622,170 | A | 11/1971 | Sedgwick |
| 3,998,467 | A | 12/1976 | Petkovich |
| 4,205,572 | A | 6/1980 | Weiner |
| 4,237,659 | A | 12/1980 | Welsch et al. |
| 4,575,937 | A | 3/1986 | McCullough |

(Continued)

FOREIGN PATENT DOCUMENTS

| | | |
|---|---|---|
| CN | 202114710 U | 1/2012 |
| DE | 3741484 C1 | 8/1989 |

(Continued)

*Primary Examiner* — Thomas M Wittenschlaeger

(74) *Attorney, Agent, or Firm* — J-Tek Law PLLC; Jeffrey D. Tekanic; Scott T. Wakeman

(57) ABSTRACT

A power tool (1), such as a multi-tool, includes: a motor (21) extending in a front-rear direction; a motor housing (2) that houses the motor (21); a head housing (7) held forward of the motor housing (2); and an output shaft (60) protruding downward from the head housing (7). The head housing (7) may be made of a resin. In addition or in the alternative, the head housing (7) includes a lower-head housing case (4) screw fastened to an upper-head housing cover (5). In addition or in the alternative, the motor housing has a two-halved structure in which two half housings (2*a*, 2*b*) are screw fastened together.

15 Claims, 7 Drawing Sheets

(56) References Cited

U.S. PATENT DOCUMENTS

| | | | | |
|---|---|---|---|---|
| 4,590,900 | A | 5/1986 | Hayashi | |
| 4,597,227 | A | 7/1986 | Gentischer et al. | |
| 4,747,607 | A | 5/1988 | Emter | |
| 4,989,374 | A | 2/1991 | Rudolf et al. | |
| 5,031,361 | A | 7/1991 | MacKay | |
| 5,157,873 | A | 10/1992 | Rudolf et al. | |
| 5,263,283 | A | 11/1993 | Rudolf et al. | |
| 5,468,176 | A | 11/1995 | Udert et al. | |
| 5,573,255 | A | 11/1996 | Salpaka | |
| 5,575,071 | A | 11/1996 | Phillips et al. | |
| 5,601,483 | A | 2/1997 | Rudolf et al. | |
| 5,658,193 | A * | 8/1997 | McCambridge | B23D 49/162 451/344 |
| 5,759,093 | A * | 6/1998 | Rodriguez | A45D 29/05 132/73.6 |
| 5,919,085 | A * | 7/1999 | Izumisawa | B24B 23/04 451/357 |
| 5,946,810 | A | 9/1999 | Hoelderlin et al. | |
| 6,142,858 | A | 11/2000 | Luedeke | |
| 6,244,943 | B1 * | 6/2001 | Bohler | B24B 11/00 451/294 |
| 6,321,622 | B1 | 11/2001 | Tsuge et al. | |
| 6,569,001 | B2 | 5/2003 | Rudolf et al. | |
| 6,612,039 | B2 | 9/2003 | Kakiuchi et al. | |
| 6,623,202 | B2 | 9/2003 | Hansson et al. | |
| 6,735,876 | B2 | 5/2004 | Hirabayashi | |
| 6,796,888 | B2 | 9/2004 | Jasch | |
| 6,860,792 | B2 | 3/2005 | Krondorfer et al. | |
| 6,887,142 | B2 | 5/2005 | Rupprecht et al. | |
| 6,910,694 | B2 | 6/2005 | Hartmann et al. | |
| 6,949,110 | B2 | 9/2005 | Ark et al. | |
| 7,344,435 | B2 | 3/2008 | Pollak et al. | |
| 7,497,860 | B2 * | 3/2009 | Carusillo | A61B 17/142 606/82 |
| 7,537,065 | B2 * | 5/2009 | Gallagher | B24B 23/02 173/170 |
| 7,719,146 | B2 * | 5/2010 | Takahashi | H02K 5/15 310/50 |
| 7,789,737 | B2 | 9/2010 | Liersch | |
| 7,997,586 | B2 | 8/2011 | Ziegler et al. | |
| 8,042,437 | B2 | 10/2011 | Maier et al. | |
| 8,113,520 | B2 | 2/2012 | Zaiser et al. | |
| 8,181,973 | B2 | 5/2012 | Dezheng et al. | |
| 8,182,316 | B2 | 5/2012 | Peisert | |
| 8,187,058 | B2 | 5/2012 | Blickle et al. | |
| 8,272,135 | B2 | 9/2012 | Zhou | |
| 8,317,574 | B2 | 11/2012 | Blickle et al. | |
| 8,641,049 | B2 | 2/2014 | Marini et al. | |
| 8,851,960 | B2 * | 10/2014 | Ikuta | B25F 5/006 451/359 |
| 8,895,880 | B2 * | 11/2014 | Mizutani | B25F 5/02 200/332.2 |
| 8,960,688 | B2 | 2/2015 | Zhou | |
| 9,073,563 | B2 * | 7/2015 | Middleton | B23D 51/10 |
| 9,108,255 | B2 | 8/2015 | Li | |
| 9,120,216 | B2 | 9/2015 | Zhang et al. | |
| 9,221,156 | B2 * | 12/2015 | Bachman | B25B 21/004 |
| 9,486,909 | B2 | 11/2016 | Ziegler et al. | |
| 9,555,554 | B2 | 1/2017 | Thorson et al. | |
| 9,737,969 | B2 | 8/2017 | Bek et al. | |
| 10,213,852 | B2 * | 2/2019 | Qian | B24B 23/04 |
| 2002/0035882 | A1 | 3/2002 | Hartmann | |
| 2002/0070037 | A1 | 6/2002 | Jasch | |
| 2002/0170408 | A1 | 11/2002 | Hartmann et al. | |
| 2003/0100251 | A1 | 5/2003 | Besch | |
| 2005/0095966 | A1 | 5/2005 | Jasch et al. | |
| 2005/0156390 | A1 | 7/2005 | Marini et al. | |
| 2006/0172669 | A1 | 8/2006 | Hesse et al. | |
| 2007/0060030 | A1 | 3/2007 | Pollak et al. | |
| 2007/0082590 | A1 | 4/2007 | Kraenzler et al. | |
| 2007/0295156 | A1 | 12/2007 | Ziegler et al. | |
| 2009/0023371 | A1 | 1/2009 | Blickle et al. | |
| 2009/0273146 | A1 | 11/2009 | Dezheng et al. | |
| 2010/0047036 | A1 | 2/2010 | Hirabayashi et al. | |
| 2010/0197208 | A1 | 8/2010 | Blickle et al. | |
| 2010/0236806 | A1 | 9/2010 | Heilig et al. | |
| 2011/0074122 | A1 | 3/2011 | Marini et al. | |
| 2011/0086582 | A1 | 4/2011 | Takemura et al. | |
| 2011/0260414 | A1 | 10/2011 | Ota et al. | |
| 2011/0266759 | A1 | 11/2011 | Goldman | |
| 2011/0316241 | A1 | 12/2011 | Zhang et al. | |
| 2012/0067607 | A1 | 3/2012 | Weber et al. | |
| 2012/0139196 | A1 | 6/2012 | Zhou | |
| 2012/0169018 | A1 | 7/2012 | Lu et al. | |
| 2013/0047762 | A1 | 2/2013 | Hecht et al. | |
| 2013/0193653 | A1 | 8/2013 | Marini et al. | |
| 2013/0193655 | A1 | 8/2013 | Kaye et al. | |
| 2014/0084552 | A1 | 3/2014 | Zieger et al. | |
| 2014/0191481 | A1 | 7/2014 | Kawakami et al. | |
| 2014/0290072 | A1 | 10/2014 | Brown et al. | |
| 2016/0184956 | A1 | 6/2016 | Klabunde et al. | |
| 2016/0199919 | A1 | 7/2016 | Klabunde et al. | |
| 2016/0271711 | A1 * | 9/2016 | Qian | B24B 27/08 |
| 2016/0288288 | A1 | 10/2016 | Klabunde et al. | |
| 2017/0080545 | A1 * | 3/2017 | Furusawa | B27B 19/006 |
| 2018/0243894 | A1 * | 8/2018 | Wang | B24B 23/04 |
| 2018/0319001 | A1 * | 11/2018 | Zhong | B24B 41/007 |
| 2019/0030616 | A1 * | 1/2019 | Hess | B24B 47/12 |

FOREIGN PATENT DOCUMENTS

| | | | |
|---|---|---|---|
| DE | 29605728 | U1 | 9/1996 |
| DE | 10030586 | A1 | 1/2002 |
| DE | 102004020982 | A1 | 11/2005 |
| DE | 102005047400 | B | 12/2006 |
| DE | 102005031802 | A1 | 1/2007 |
| DE | 102005047402 | A1 | 4/2007 |
| DE | 602005003595 | | 11/2008 |
| DE | 102007035045 | A1 | 1/2009 |
| DE | 202011050511 | U1 | 11/2011 |
| DE | 202011050937 | U1 | 11/2011 |
| DE | 102011005021 | A1 | 9/2012 |
| DE | 102011005818 | A1 | 9/2012 |
| DE | 102011085561 | A1 | 12/2012 |
| EP | 0577579 | A1 | 1/1994 |
| EP | 0596831 | A1 | 5/1994 |
| EP | 1182019 | A | 2/2002 |
| EP | 1852218 | A1 | 11/2007 |
| EP | 1790434 | B1 | 3/2008 |
| EP | 1852218 | B1 | 6/2010 |
| JP | S62181901 | A | 8/1987 |
| JP | S63173802 | U | 11/1988 |
| JP | 2000167785 | A | 6/2000 |
| JP | 2002126944 | | 5/2002 |
| JP | 2003025145 | A | 1/2003 |
| JP | 2004351538 | A | 12/2004 |
| JP | 2008238321 | A | 10/2008 |
| WO | 9623627 | A1 | 8/1996 |
| WO | 2005049275 | A1 | 6/2005 |
| WO | 2005102605 | A | 11/2005 |
| WO | 2012007203 | A1 | 1/2012 |
| WO | 2012045679 | A2 | 4/2012 |

* cited by examiner

POWER TOOL

CROSS-REFERENCE

The present application claims priority to Japanese patent application serial number 2018-062172 filed on Mar. 28, 2018, the contents of which are incorporated fully herein by reference.

TECHNICAL FIELD

The present invention relates to a power tool, such as a so-called multi-tool, and more particularly to a power tool comprising a motor housing that houses a motor, a head housing held forward of the motor housing, and an output shaft protruding downward from the head housing.

BACKGROUND ART

WO 2012/045679 discloses a so-called "multi-tool" that is capable of performing a variety of types of work, such as cutting masonry boards (drywall) and wood, detaching plastic tiles, grinding wood materials, etc., by exchanging the tool accessory (e.g., blade, etc.) secured to an output shaft.

SUMMARY OF THE INVENTION

However, because a head housing (head cover) of the above-described known multi-tool is integrally made of metal (e.g., an aluminum alloy), the multi-tool is heavy and the multi-tool is not ergonomic and/or it is not easy to assemble.

Therefore, it is one non-limiting object of the present teachings to improve the ergonomics and/or simplify the assembly of a power tool comprising a motor housing, a head housing held forward of the motor housing, and an output shaft protruding downward from the head housing.

In a first aspect of the present teachings, a power tool comprises: a motor extending in a front-rear direction; a motor housing that houses the motor; a head housing held forward of the motor housing; and an output shaft protruding downward from the head housing. The head housing is made of a resin.

As a result, the power tool can be made more lightweight than the above-described known multi-tool, thereby improving ergonomics.

In a second aspect of the present teachings, a power tool comprises: a motor extending in a front-rear direction; a motor housing that houses the motor; a head housing held forward of the motor housing; and an output shaft protruding downward from the head housing. The head housing has a divided structure.

According to the above-described second aspect, for example, when assembling (mounting) the spindle unit in the inner part of the head housing, this assembly work can be performed more efficiently because the head housing is divided into the lower-head housing case and the upper-head housing cover. Accordingly, compared with the (non-divided) head housing of the above-described known multi-tool, the spindle unit can be more easily assembled (inserted) into the inner part of the head housing.

In addition, the divided structure optionally may comprise an upper half and a lower half, such that an upper-head housing case is joined to a lower-head housing cover. A dividing line (plane) between the upper and lower halves is located upward of an axis line (rotational axis) of the motor.

In such an embodiment, for example, if the power tool is a multi-tool, even if a torque acts on the lower-head housing case owing to the repetitive oscillating of the cutting tool about the axis of the output shaft, the lower-head housing case can be provided with sufficient stiffness to counteract this torque.

In addition or in the alternative, a rib may be formed on the upper-head housing cover and mates with the lower-head housing case. A tip side of the output shaft may be rotatably supported by the lower-head housing case via a bearing. An outer ring of the bearing may be held by the lower-head housing case. A tip of the rib preferably presses against the outer ring of the bearing.

In such an embodiment, rattling of the bearing in the axial direction can be prevented during operation of the power tool.

In a third aspect of the present teachings, a power tool comprises: a motor extending in a front-rear direction; a motor housing that houses the motor; a head housing held forward of the motor housing; and an output shaft protruding downward from the head housing. The head housing is integrally constituted. The motor housing has a two-halved structure in which half housings are joined.

In the above-described third aspect, the strength of the head housing can be increased over embodiments in which the head housing has a divided structure. In addition, because the motor housing is divided into two halves, the internal components (e.g., the motor, the centrifugal fan, the switch, etc.) can be joined to the housing part of the motor housing, thereby increasing the efficiency of this joining work.

DETAILED DESCRIPTION OF EMBODIMENTS

Figure 1:
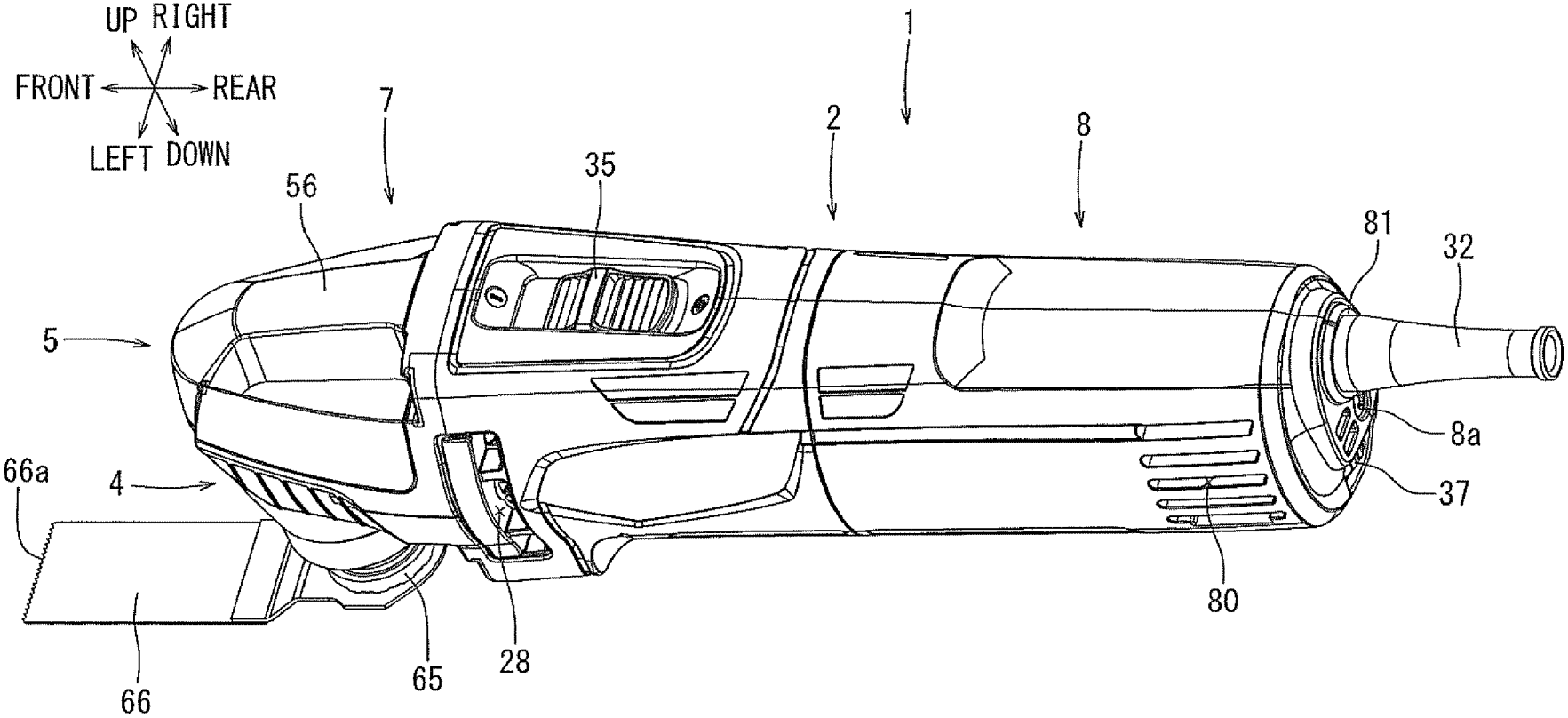
FIG. 1 is a general oblique view of a multi-tool according to a first embodiment.
Figure 2:
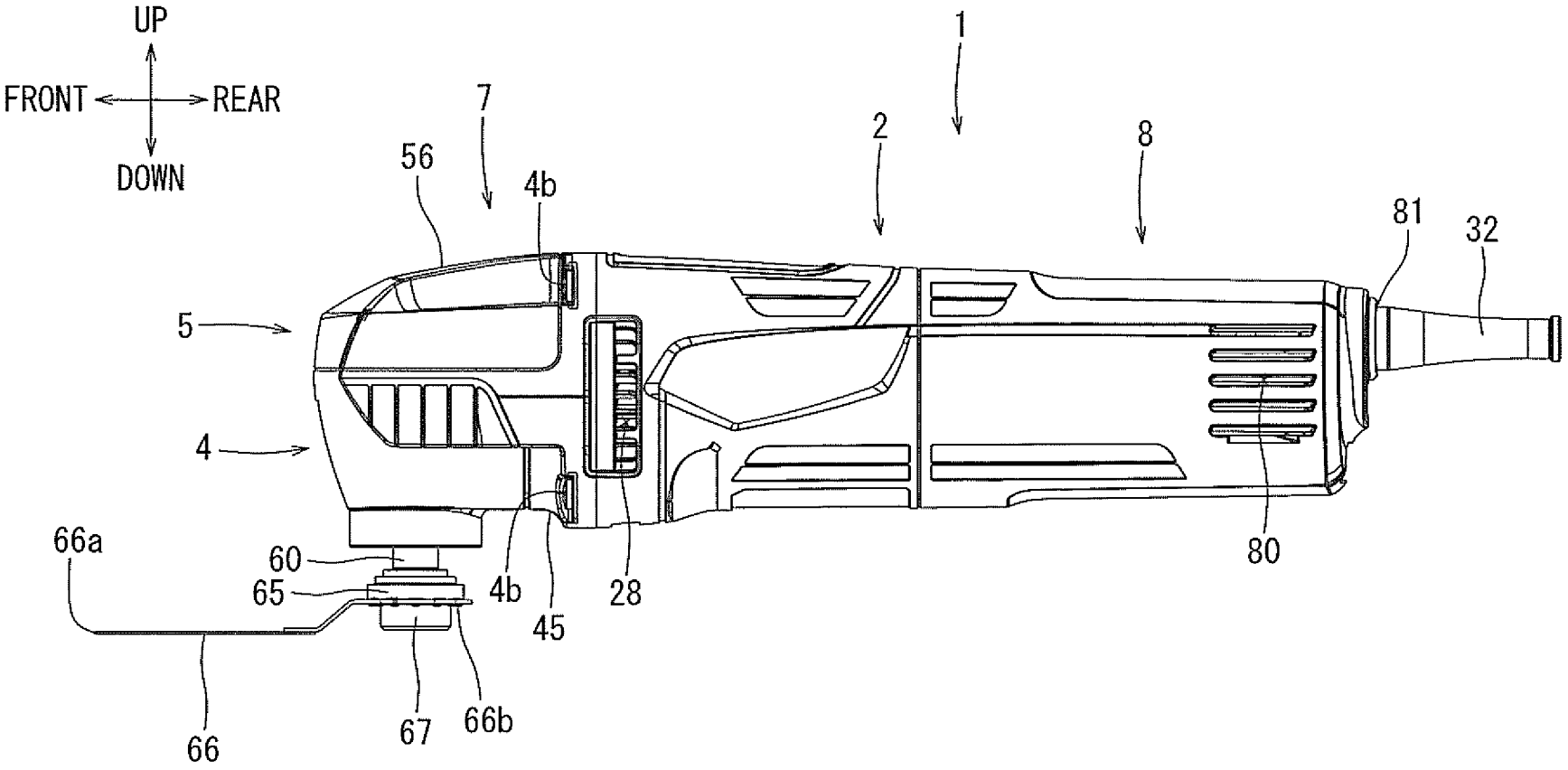
FIG. 2 is a side view of the multi-tool shown in FIG. 1.
Figure 3:
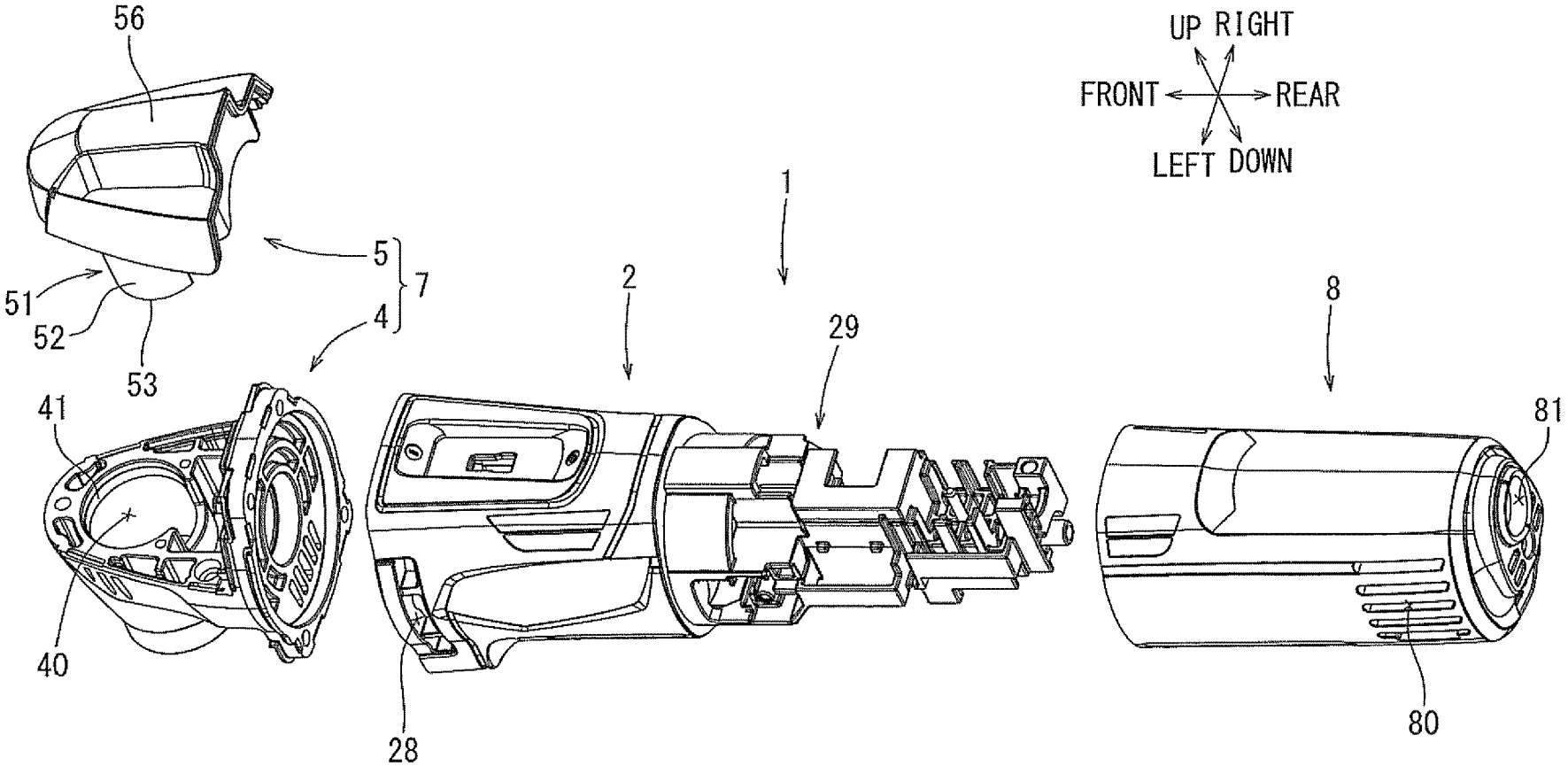
FIG. 3 is an exploded view of the multi-tool shown in FIG. 1.
Figure 4:
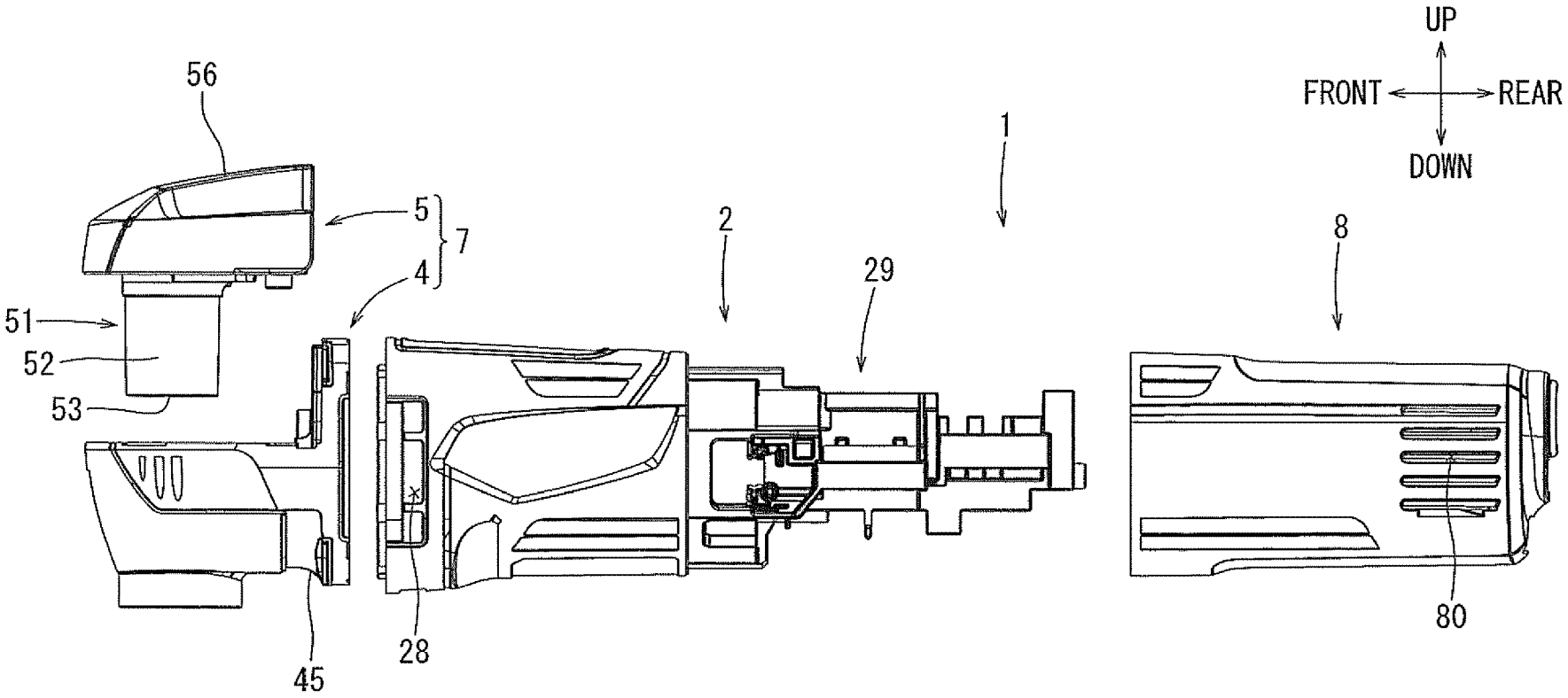
FIG. 4 is a side view of the multi-tool shown in FIG. 3.

Embodiments of the present teachings will be explained below, with reference to the drawings.

First Embodiment

A first embodiment of the present teachings will now be explained, with reference to FIGS. 1-6. It is noted that, in the following, examples are explained in which a "power tool" and an "output shaft" according to the present teachings are exemplified by a "multi-tool 1" and a "spindle 60," respectively. In addition, in the following explanation, the terms "below", "up", "down", "front", "rear", "left", and "right" indicate the up, down, front, rear, left, and right directions noted in the drawings mentioned above. That is, the forward direction is the tip direction of the multi-tool 1. This applies likewise in a second embodiment, which is described further below.

The multi-tool 1 principally comprises a motor housing 2, a head housing (head cover) 7, and a rear cover 8 (refer to FIGS. 1-4). The motor housing 2, the head housing 7, and the rear cover 8 are described individually below.

First, the motor housing 2 will be explained. The motor housing 2 is integrally constituted (as one component) from a substantially tubular component made of resin. A motor 21 is joined to (mounted in) a housing part 20 (a tubular inner part) of the motor housing 2 such that the motor 21 extends in the front-rear direction (refer to FIG. 5). A centrifugal fan 23 is joined to (mounted on) a front side of a rotary shaft 22 of the motor 21. In addition, a first bearing 24 is assembled onto (mounted on) the rotary shaft 22 of the motor 21 on a front side of the centrifugal fan 23.

A second bearing 25 is joined to (mounted on) the rotary shaft 22 of the motor 21 on the front side of the bearing 24. The second bearing 25 is configured and mounted (refer to FIG. 6) such that a second axis line b, which is the shaft axis of the second bearing 25, is eccentric (displaced) with respect to (relative to) a first axis line a, which is the shaft axis (rotational axis) of the rotary shaft 22 of the motor 21 (refer to FIG. 6). That is, the second bearing 25 is mounted such that it is eccentric with respect to the rotary shaft 22 of the motor 21.

On the other side, a third bearing 26 is joined to (mounted on) a rear side of the rotary shaft 22 of the motor 21. The first and third bearings 24, 26 constitute the bearings of the rotary shaft 22 of the motor 21. Consequently, outer rings of both of the bearings 24, 26 are joined (affixed) to the housing part 20 of the motor housing 2. Accordingly, the rotary shaft 22 of the motor 21 can be rotated smoothly.

In addition, a dish-shaped fan guide 27, which surrounds the circumference of the centrifugal fan 23, is joined, with the rotary shaft 22 of the motor 21 inserted therethrough, to the housing part 20 between the motor 21 and the centrifugal fan 23 of the motor housing 2. The fan guide 27 makes it possible to increase the wind speed of outside air (cooling air) drawn in through air-suction ports 80 of the rear cover 8, which are described below. In addition, air-exhaust ports 28 for exhausting the outside air drawn in through the air-suction ports 80 of the rear cover 8 are formed on the left and right (left- and right-side surfaces) of the motor housing 2.

A rearward-extending projection 29 is formed on a rear part of the motor housing 2. A switch 31 is joined to (mounted on) the front side of the projection 29 via a switch cover 30 (refer to FIG. 5). In addition, a terminal block 33 is electrically connected to a power-supply cord 32 (for connecting to an external power supply) and is joined to (mounted on) a rear side of the projection 29. In addition, a controller 34, which drives the rotary shaft 22 of the motor 21, is joined to (mounted on) the rear side of the projection 29. In addition, a switch knob 35, which is operable (slidable) by a finger of a user, is joined to (mounted on) an upper side of the motor housing 2.

In addition, a switch lever 36, which is interlocked with the operation (movement) of the switch knob 35 and actuates the switch 31, is joined to (mounted on) the housing part 20 of the motor housing 2. In addition, a speed-changing dial 37 for setting the rotational speed of the rotary shaft 22 of the motor 21 driven by the controller 34 is joined to (mounted on) a rear side of the projection 29. It is noted that the motor 21, the switch 31, the terminal block 33, and the speed-changing dial 37 are electrically connected to the controller 34 via lead wires (not shown). The motor housing 2 is thus configured.

Next, the head housing 7 will be explained. The head housing 7 principally comprises a lower-head housing case 4, an upper-head housing cover 5, and a spindle unit 6.

The lower-head housing case 4 is integrally constituted (as one component) from a component made of a resin such that it has an inverted, substantially L-shaped housing part 40. An inner diameter of an inner-circumferential surface 41 of the housing part 40 is set equal to or slightly larger than an outer diameter of an outer ring 63*b* of a bearing 63 of the spindle 60 of the spindle unit 6, which is described below. Consequently, as described below, when the spindle unit 6 is joined to (mounted within) the housing part 40, rattling of the spindle unit 6 in radial directions can be prevented.

A through hole 42 is formed in a lower side of the housing part 40, and the spindle 60 of the spindle unit 6 is inserted through the through hole 42. In addition, a joining part 43, which projects from the inner-circumferential surface 41 toward the center of the through hole 42, is formed on a lower side of the housing part 40. A portion of the surface of the lower-head housing case 4 is covered by an elastomer 45, such as a two-color molded elastomer 45, to attenuate the transmission of vibration from the lower-head housing case 4 to the user's hand. The lower-head housing case 4 is thus configured.

In addition, the upper-head housing cover 5 is integrally constituted (as one component) from a component made of a resin such that, when the spindle unit 6 is joined to (mounted within) the housing part 40 of the lower-head housing case 4, the upper-head housing cover 5 covers the spindle unit 6. A substantially circular-cylinder-shaped rib 51 protrudes downward from a divided surface 50 of the upper-head housing cover 5.

A base-end-side outer diameter of an outer-circumferential surface 52 of the rib 51 is set equal to or slightly larger than an upper-side inner diameter of the inner-circumferential surface 41 of the housing part 40 of the lower-head housing case 4. Consequently, as described below, when the upper-head housing cover 5 is joined to (mounted on) the lower-head housing case 4, the outer-circumferential surface 52 of the rib 51 of the upper-head housing cover 5 mates with the inner-circumferential surface 41 of the lower-head housing case 4. Accordingly, rattling of the joined upper-head housing cover 5 in the radial directions can be reduced.

In addition, a recessed groove 54 is formed on (in) the divided (downward-facing) surface 50 of the upper-head housing cover 5. A seal ring 55 is joined to (placed in) the recessed groove 54. Consequently, as described below, after the upper-head housing cover 5 has been joined to the lower-head housing case 4, the seal ring 55 prevents (blocks) grease (not shown), which is applied to the spindle unit 6 disposed within the housing part 40 of the lower-head housing case 4, from leaking out between a divided (upward-facing) surface 44 of the lower-head housing case 4 and the divided surface 50 of the upper-head housing cover 5, which face (adjoin) each other in the assembled state of the multi-tool 1.

In addition, a portion of the surface of the upper-head housing cover 5 is covered by another elastomer 56, such as a two-color molded elastomer 56, to attenuate the transmission of vibration from the upper-head housing cover 5 to the user's hand. The upper-head housing cover 5 is thus configured.

In addition, the spindle unit 6 comprises: the spindle 60; a lever 61 having a base end joined (fastened) to an upper part of the spindle 60; the bearing 63, which is joined to (mounted on) a lower-end side (tip side) of the spindle 60; and a bearing 64, which is joined to (mounted on) an upper-end side (base-end side) of the spindle 60. A clamping part 62, which has opposing left and right pressing surfaces 62*a* and is substantially U-shaped in plan view, is formed on a tip of the lever 61.

Figure 6:
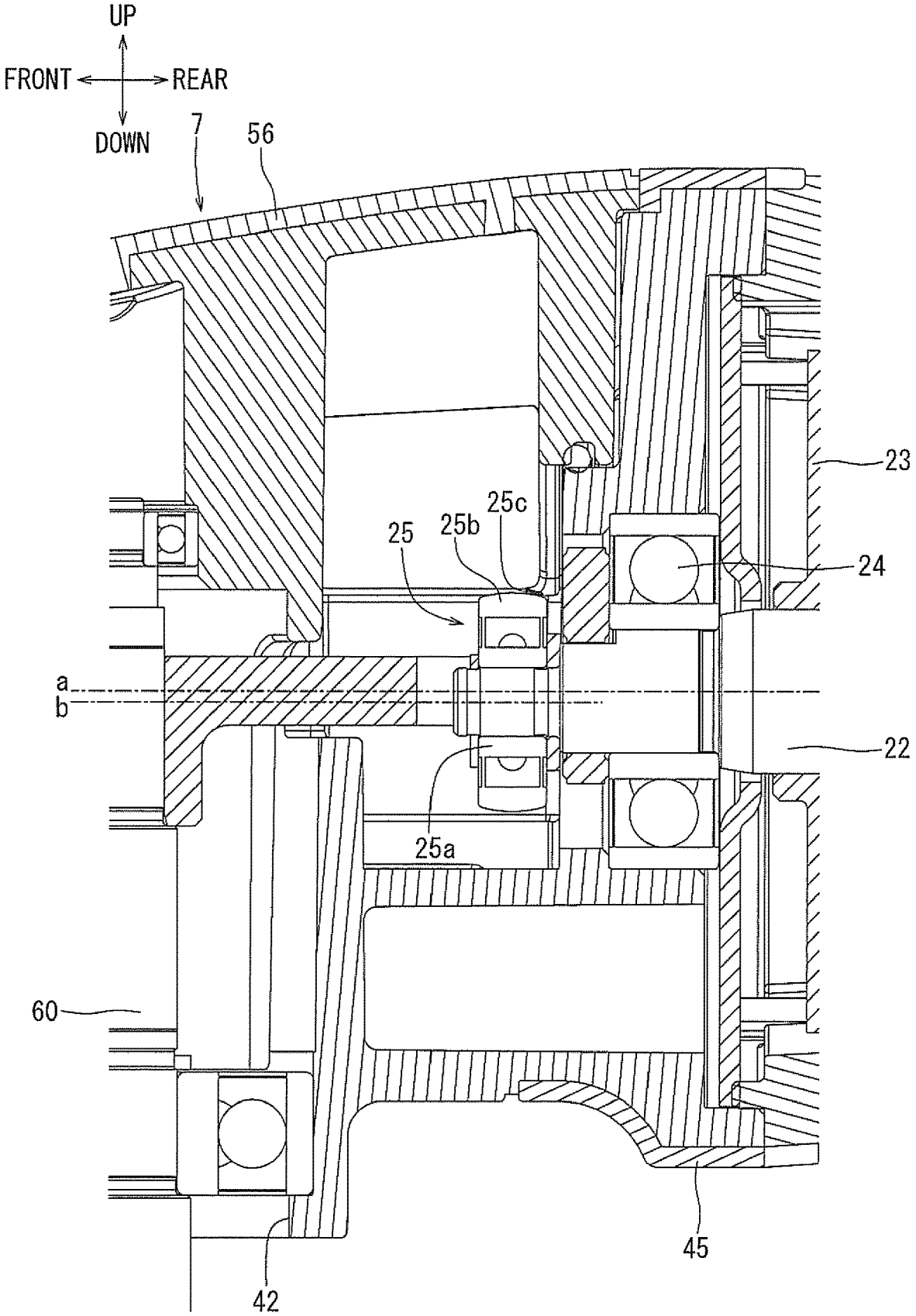
FIG. 6 is an enlarged view of the principal parts shown in FIG. 5.

The above-described second bearing 25 of the rotary shaft 22 of the motor 21 is received (disposed) between the two pressing surfaces 62*a* of the clamping part 62 (refer to FIG. 6). In addition, a mounting part 65 is joined (fastened) to a lower-end side of the spindle 60. Protrusions 65*a* are formed along a circumferential direction (a circle) on a lower surface of the mounting part 65. The spindle unit 6 is thus configured.

A procedure for assembling the above-described lower-head housing case 4, the upper-head housing cover 5, and the spindle unit 6 to form the head housing 7 will now be explained. First, the spindle unit 6 is joined to (mounted in) the housing part 40 of the lower-head housing case 4. As a result, the spindle 60 of the spindle unit 6 protrudes downward from (through) the through hole 42 of the lower-head housing case 4.

Figure 5:
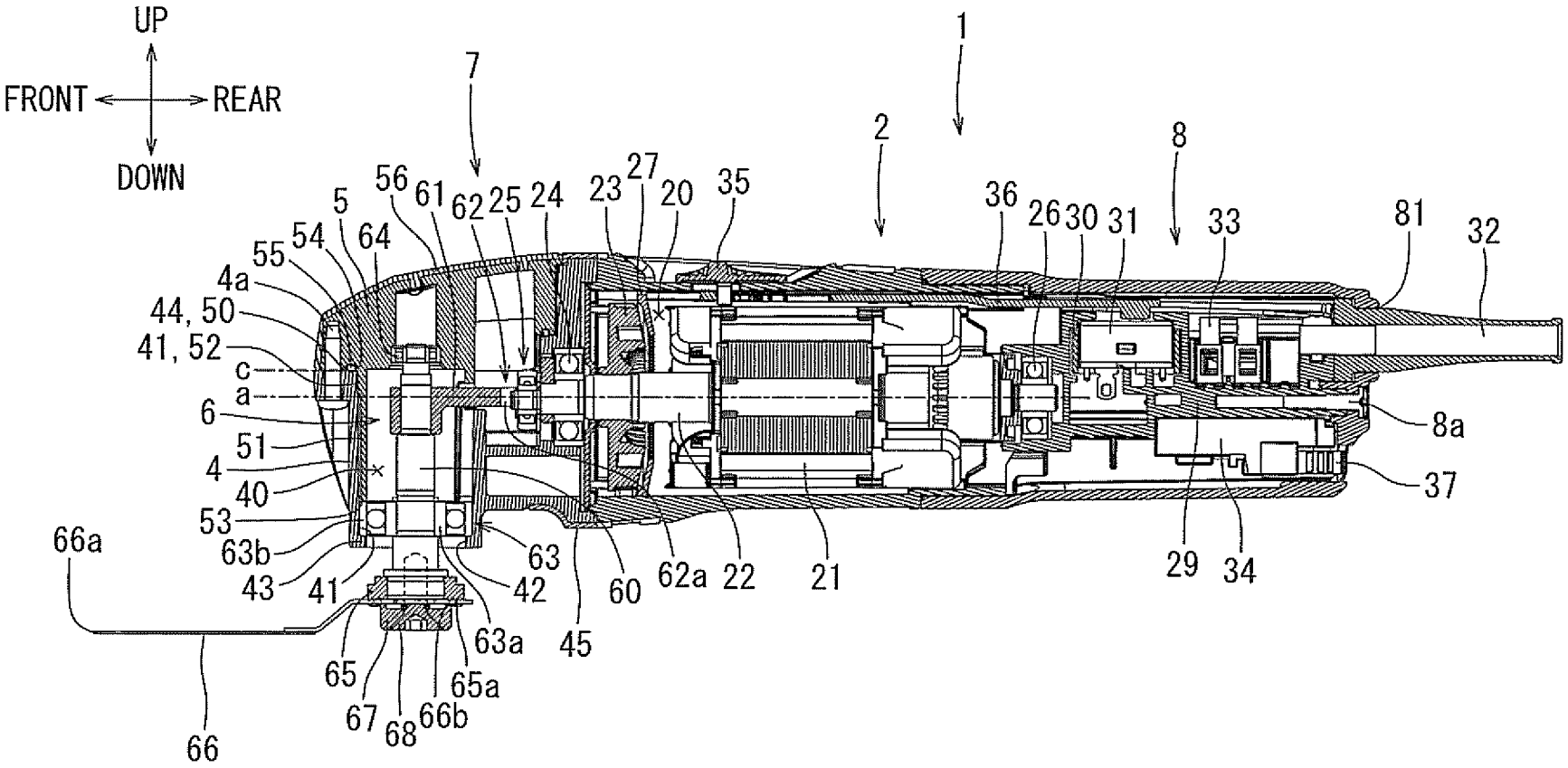
FIG. 5 is a longitudinal-cross-sectional view of FIG. 2.

Next, the upper-head housing cover 5 is joined to (mounted on) the lower-head housing case 4, which contains the spindle unit 6. It is noted that, as can be seen in FIG. 5, a dividing line (plane) c, at (along) which the divided surface 44 of the lower-head housing case 4 and the divided surface 50 of the upper-head housing cover 5 meet, is located (extends) upward of the first axis line a of the rotary shaft 22 of the motor 21.

In this joined state, a tip 53 of the rib 51 of the upper-head housing cover 5 downwardly presses against the outer ring 63*b* of the bearing 63 of the spindle unit 6 joined to the lower-head housing case 4. Then, three screws 4*a* are fastened from the lower-head housing case 4 into the upper-head housing cover 5. In this way, the head housing 7 is assembled.

Lastly, the rear cover 8 will be explained. The rear cover 8 is integrally constituted (as one component) from a bottomed, substantially tubular component made of a resin. Groove-shaped air-suction ports 80 for drawing in outside air are formed on the left and right (left and right side surfaces) on the rear side of the rear cover 8. In addition, a through hole 81, through which the power-supply cord 32 can pass, is formed on the rear side of the rear cover 8. The rear cover 8 is thus configured.

Next, a procedure for assembling the motor housing 2, the head housing 7, and the rear cover 8 to form the multi-tool 1 will be explained. First, the rear cover 8 is joined to the motor housing 2 such that it covers the projection 29 of the motor housing 2. Then, a screw 8*a* is fastened from the rear cover 8 into the projection 29 of the motor housing 2. Thereafter, the head housing 7 is joined to the motor housing 2.

Furthermore, four screws 4*b* are fastened from the head housing 7 into the motor housing 2 so that the head housing 7 is held (secured) forward of the motor housing 2. Lastly, a cutting tool 66 having a blade 66*a* is interposed (sandwiched) between the mounting part 65 of the spindle 60 and an outer flange 67, and then a flat-head screw 68 is tightened against the outer flange 67 into the mounting part 65 of the spindle 60. Thereby, the cutting tool 66 is mounted on the mounting part 65 of the spindle 60.

It is noted that a circle of cutout holes 66*b* is formed in the cutting tool 66 such that they correspond to the circle of protrusions 65*a* of the mounting part 65. Consequently, when the cutting tool 66 is sandwiched (interleaved) between the mounting part 65 of the spindle 60 and the outer flange 67, the protrusions 65*a* of the mounting part 65 are respectively inserted into cutout holes 66*b* formed in the cutting tool 66. Accordingly, the cutting tool 66 can be mounted on the mounting part 65 of the spindle 60 with the blade 66*a* oriented frontward. In this way, the multi-tool 1 is assembled.

A representative method for operating the multi-tool 1 assembled as described above will now be explained. When the switch knob 35 is operated (manipulated, slid) by the user's finger, the motor 21 is driven by the controller 34. Thereby, the rotary shaft 22 of the motor 21 rotates. Thereupon, because the second bearing 25 is eccentrically mounted with respect to (relative to) the rotary shaft 22 of the motor 21, an outer-circumferential surface 25*c* of an outer ring 25*b* of the bearing 25 alternately presses (pushes) against the opposing left/right pressing surfaces 62*a* of the lever 61 of the spindle unit 6.

This causes the lever 61 to repetitively oscillate about the pivot axis of the spindle 60, whereby the cutting tool 66 also oscillates (pivots) repetitively about the pivot axis of the spindle 60. Therefore, a workpiece, such as a masonry board (not shown), can be cut owing to the repetitive oscillating (pivoting movement) of the blade 66*a* of the cutting tool 66. At this time, the centrifugal fan 23 also rotates together with the rotary shaft 22 of the motor 21. Thereupon, outside air is drawn in from (through) the air-suction ports 80 of the rear cover 8 into the interior of the rear cover 8, and this drawn-in outside air is subsequently exhausted from (through) the air-exhaust ports 28 of the motor housing 2.

Because the inner part of the rear cover 8 and the housing part 20 of the motor housing 2 serve as a passageway for the outside air (i.e., because the outside air is delivered into the interior of the rear cover 8 and the housing part 20 of the motor housing 2), internal components, such as the controller 34, the motor 21, etc., are cooled. Accordingly, the motor 21 and the controller 34 can be prevented from overheating during operation.

The multi-tool 1 according to the first embodiment is configured as described above. According to this configuration, the head housing 7 is constituted from components made of resin. Consequently, as compared to the above-described known multi-tool, the multi-tool 1 of this aspect of the present teachings can be made more lightweight, thereby improving ergonomics (ease of use).

In addition, according to this configuration, the head housing 7 has a two-halved structure in which the lower-head housing case 4 and the upper-head housing cover 5 are joined together. Consequently, when the spindle unit 6 is joined to (mounted in) the inner part of the head housing 7, this joining work can be carried out more efficiently, because the head housing 7 is divided into the lower-head housing case 4 and the upper-head housing cover 5. Accordingly, compared with the head housing 7 of the above-described known multi-tool, the spindle unit 6 can be joined to (mounted in) the interior of the head housing 7 more easily and efficiently.

In addition, according to this configuration, the dividing line (plane) c between the divided surface 44 of the lower-head housing case 4 and the divided surface 50 of the upper-head housing cover 5 is located upward of the first axis line a of the rotary shaft 22 of the motor 21. Consequently, even if a torque acts on the lower-head housing case 4 owing to the repetitive oscillating of the cutting tool 66 about the pivot axis of the spindle 60 of the spindle unit 6, the lower-head housing case 4 can be provided with sufficient stiffness to counteract this torque.

In addition, according to this configuration, when the spindle unit 6 has been joined to (mounted in) the interior of the head housing 7 (the housing part 40 of the lower-head housing case 4), the tip 53 of the rib 51 of the upper-head housing cover 5 presses axially downward against the outer ring 63*b* of the bearing 63 of the spindle unit 6 joined to the lower-head housing case 4. Consequently, in this joined state, rattling of the bearing 63 in the axial direction of the spindle 60 can be prevented.

Second Embodiment

Next, a second embodiment of the present teachings will be explained, with reference to FIG. 7. A multi-tool 101 according to the second embodiment differs from the multi-tool 1 according to the first embodiment in the structures of the motor housing 2 and the head housing 7. It is noted that, in the explanation below, components of structural elements that are the same as or equivalent to components explained in the first embodiment are assigned the same numerals and symbols in the drawing, and redundant explanations thereof are omitted.

Figure 7:
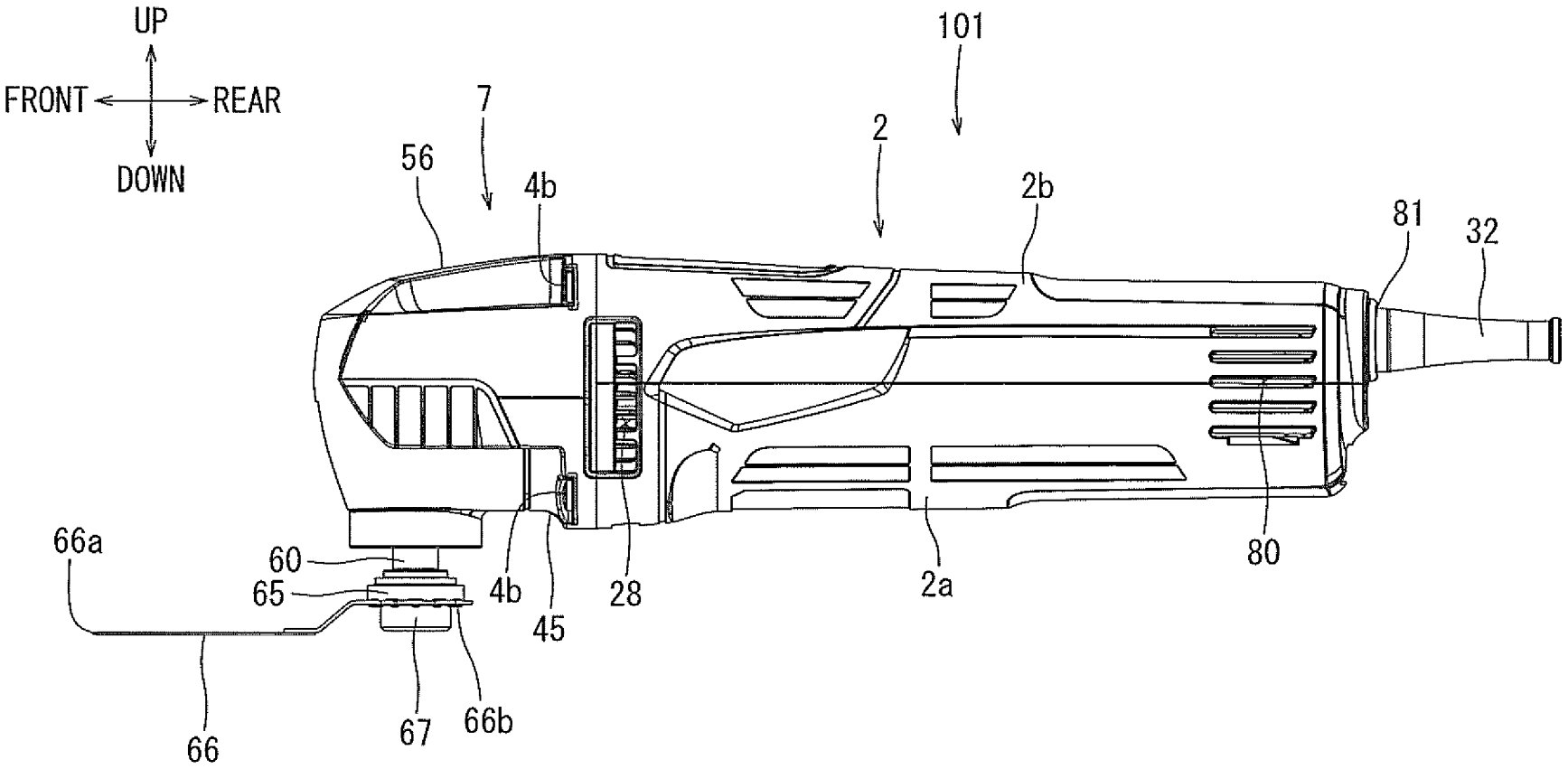
FIG. 7 is a side view of the multi-tool according to a second embodiment.

The multi-tool 101 principally comprises the motor housing 2 and the head housing 7 (refer to FIG. 7). The motor housing 2 of the multi-tool 101 also serves as the rear cover 8 of the first embodiment and is composed of a bottomed, substantially tubular component made of resin. It is noted that the motor housing 2 of the multi-tool 101, as can be seen in FIG. 7, has a two-halved structure in which upper and lower half housings 2*a*, 2*b* are joined together by screws (not shown).

In addition, the head housing 7 of the multi-tool 101 is integrally constituted by (as one component) the lower-head housing case 4 and the upper-head housing cover 5 of the first embodiment. It is noted that other structures of the multi-tool 101 are the same as those of the multi-tool 1.

The multi-tool 101 according to the second embodiment of the present invention is configured as described above. According to this configuration, functions and effects the same or similar as those in the multi-tool 1 can be obtained. In addition, the head housing 7 of the multi-tool 101 is integrally constituted (i.e. as one integral unit without seams). Consequently, the strength of the head housing 7 can be increased as compared to a head housing having a divided structure. In addition, the motor housing 2 of the multi-tool 101 has a two-halved structure in which the upper and lower half housings 2*a*, 2*b* are joined by screws. Consequently, because the motor housing 2 of the second embodiment is divided into an upper half and a lower half, the components (e.g., the motor 21, the centrifugal fan 23, the switch 31, etc.) can be joined to the housing part 20 of the motor housing 2 more easily and efficiently during assembly.

The details described above strictly relate to the embodiments of the present invention, and the present invention is not limited thereto.

In the embodiments, examples were explained in which the "power tool" is the "multi-tool 1, 101." However, embodiments of the present teachings are not limited thereto, and the "power tool" may be otherwise configured, e.g., as an "angle-type power tool."

In addition, in the first embodiment, an example was explained in which the head housing 7 has an up-down two-halved structure. However, the first embodiment is not limited thereto, and the head housing 7 may have a front-rear two-halved structure or a left-right two-halved structure. Of course, the head housing 7 may be integrally constituted (as one component) from a component made of resin, as in the second embodiment.

In addition, in the first embodiment an example was explained in which the motor housing 2 is integrally constituted (as one component) from a substantially tubular component made of resin. However, the first embodiment is not limited thereto, and the motor housing 2 may be configured in halves (as two components constituting halves), such as longitudinal halves (left and right halves) or transverse halves (upper and lower halves), from substantially tubular components made of resin, as was described in the preceding paragraph and in the first embodiment. In such additional embodiments of the present teachings, screws fasten together the two components constituting the two halves.

In addition, in the second embodiment an example was explained in which the motor housing 2 of the multi-tool 101 has a two-halved structure in which the upper and lower half housings 2*a*, 2*b* are joined together by screws. However, the second embodiment is not limited thereto, and the motor housing 2 of the multi-tool 101 may have a two-halved structure in which left and right half housings 2*a*, 2*b* are joined by screws.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved power tools, such as angled power tools and more particularly, multi-tools.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EXPLANATION OF THE REFERENCE NUMBERS

1 Multi-tool (power tool, first embodiment)
2 Motor housing
2*a* Half housing
2*b* Half housing
4 Lower-head housing case
4*a* Screw
4*b* Screw
5 Upper-head housing cover
6 Spindle unit
7 Head housing
8 Rear cover
8*a* Screw

20 Housing part
21 Motor
22 Rotary shaft
23 Centrifugal fan
24 Bearing
25 Bearing
25*a* Inner ring
25*b* Outer ring
25*c* Outer-circumferential surface
26 Bearing
27 Fan guide
28 Air-exhaust port
29 Projection
30 Switch cover
31 Switch
32 Power-supply cord
33 Terminal block
34 Controller
35 Switch knob
36 Switch lever
37 Speed-changing dial
40 Housing part
41 Inner-circumferential surface
42 Through hole
43 Joining part
44 Divided surface
45 Elastomer
50 Divided surface
51 Rib
52 Outer-circumferential surface
53 Tip
54 Recessed groove
55 Seal ring
56 Elastomer
60 Spindle (output shaft)
61 Lever
62 Clamping part
62*a* Pressing surface
63 Bearing
63*a* Inner ring
63*b* Outer ring
64 Bearing
65 Mounting part
65*a* Protrusions
66 Cutting tool
66*a* Blade
66*b* Cutout hole
67 Outer flange
68 Flat-head screw
80 Air-suction port
81 Through hole
101 Multi-tool (power tool, second embodiment)
a First axis line (motor)
b Second axis line (bearing)
c Dividing line (plane)

We claim:

1. A power tool comprising:

a motor having a rotary shaft extending in a front-rear direction;

a motor housing that houses the motor;

a head housing composed of resin and held forward of the motor housing by at least one threaded fastener inserted from a front side of the head housing into the motor housing;

an output shaft protruding downward from the head housing and extending perpendicular to the at least one threaded fastener;

a front bearing rotatably supporting a front portion of the rotary shaft of the motor and being held by the head housing;

an upper bearing rotatably supporting an upper portion of the output shaft and being held by the head housing; and a lower bearing rotatably supporting a lower portion of the output shaft and being held by the head housing;

wherein:

the head housing has a divided structure comprising an upper half and a lower half, such that a lower-head housing case is joined to an upper-head housing cover, and a dividing plane c between the upper and lower halves is located upward of a rotational axis line a of the motor.

2. The power tool according to claim 1, wherein:

a rib is formed on the upper-head housing cover and mates with the lower-head housing case;

an outer ring of the lower bearing is held by the lower-head housing case; and a tip of the rib presses against the outer ring of the lower bearing.

3. The power tool according to claim 2, wherein the motor housing has a two-halved structure in which half housings are joined.

4. The power tool according to claim 3, wherein the rotational axis line a of the motor is perpendicular to a pivot axis line of the output shaft.

5. The power tool according to claim 4, further comprising:

an eccentric bearing and a lever configured to convert rotational motion of a rotary shaft of the motor into oscillating pivoting movement of the output shaft.

6. The power tool according to claim 1, wherein the motor housing has a two-halved structure in which half housings are joined.

7. The power tool according to claim 1, wherein the rotational axis line a of the motor is perpendicular to a pivot axis line of the output shaft.

8. The power tool according to claim 1, further comprising:

an eccentric bearing and a lever configured to convert rotational motion of a rotary shaft of the motor into oscillating pivoting movement of the output shaft.

9. The power tool according to claim 1, wherein the front bearing and the lower bearing are each held in the lower-head housing case and the upper bearing is held within the upper-head housing cover.

10. The power tool according to claim 1, wherein the dividing plane c intersects the front bearing.

11. The power tool according to claim 10, wherein the front bearing and the lower bearing are each held in the lower-head housing case and the upper bearing is held within the upper-head housing cover.

12. A power tool comprising:

a motor extending in a front-rear direction;

a motor housing that houses the motor;

a head housing held forward of the motor housing; and an output shaft protruding downward from the head housing;

wherein:

the head housing has a divided structure that includes an upper-head housing and a lower-head housing, the upper-head housing is fastened to the lower-head housing by at least one threaded fastener that extends through at least a portion of the lower-head housing and into the upper-head housing such that a head of the at least one threaded fastener is seated on or in the lower-head housing;

a dividing plane c between the upper-head housing and the lower-head housing is located upward of a rotational axis line a of the motor;

a rib is formed on the upper-head housing and mates with the lower-head housing;

a tip side of the output shaft is rotatably supported by the lower-head housing via a bearing;

an outer ring of the bearing is held by the lower-head housing; and a tip of the rib presses against the outer ring of the bearing.

13. The power tool according to claim 12, wherein the motor housing has a two-halved structure in which half housings are joined.

14. A power tool comprising:

a motor having a rotary shaft extending in a front-rear direction;

a motor housing that houses the motor;

a head housing including an upper-head housing connected with a lower-head housing;

an output shaft protruding downward from the lower-head housing;

a front bearing rotatably supporting a front portion of the rotary shaft of the motor and disposed within the lower-head housing;

an upper bearing rotatably supporting an upper portion of the output shaft and being disposed within the upper-head housing; and a lower bearing rotatably supporting a lower portion of the output shaft and being disposed within the lower-head housing;

wherein:

the lower-head housing has an inner circumferential surface forming a cylindrical bore and the upper-head housing has a circular-cylindrical-shaped rib protruding downwardly from a remainder of the upper-head housing beneath the upper bearing and disposed within the cylindrical bore of the lower-head housing.

15. The power tool according to claim 14, wherein a base-end side diameter of an outer circumferential surface of the rib is equal to or larger than an upper-side inner diameter of the inner circumferential surface of the lower-head housing such that the rib mates with the lower-head housing.

* * * * *